US006581367B1

(12) United States Patent
Virag et al.

(10) Patent No.: US 6,581,367 B1
(45) Date of Patent: Jun. 24, 2003

(54) JEWELRY HAVING THE APPEARANCE OF BARBED WIRE

(76) Inventors: Neena R. Virag, 534 NE. 13th Ave., Fort Lauderdale, FL (US) 33301; Mark A. Virag, 534 NE. 13th Ave., Fort Lauderdale, FL (US) 33301

( * ) Notice: Subject to any disclaimer, the term of this patent is extended or adjusted under 35 U.S.C. 154(b) by 0 days.

(21) Appl. No.: 10/189,007

(22) Filed: Jul. 5, 2002

(51) Int. Cl.[7] ..... F16G 15/00
(52) U.S. Cl. ..... 59/92; 59/80; 59/83
(58) Field of Search ..... 59/80, 78, 83, 59/92; D11/13

(56) References Cited

U.S. PATENT DOCUMENTS

| | | | | | |
|---|---|---|---|---|---|
| 435,327 | A | * | 8/1890 | Smith, Jr. | 59/92 |
| 1,368,437 | A | * | 2/1921 | Hodell | 59/92 |
| 6,055,802 | A | * | 5/2000 | DiVietri | 59/80 |
| 6,176,073 | B1 | * | 1/2001 | Shine | 59/83 |
| 6,339,922 | B1 | * | 1/2002 | Foster | 59/80 |

FOREIGN PATENT DOCUMENTS

EP 0507718 A1 7/1992

OTHER PUBLICATIONS

Cowboy Shop of Kentucky website.
Details Toys website.
Cowboy Life, Prescott, AZ website.
Montana Silversmiths website.
Marche Noir website.
Devil's Rope Museum. www.barbwiremuseum.com.
State Line Tack website.

* cited by examiner

*Primary Examiner*—David B Jones
(74) *Attorney, Agent, or Firm*—M. K. Silverman

(57) ABSTRACT

An article of jewelry, typically in the nature of a bracelet, arm band, navel ring, toe ring, waist band, ankle band, ankle band or choker is proportioned for compressive engagement of the wrist, arm, navel, toe, waist, ankle or throat, which is formed of a malleable material, such as an alloy of two or more of tin, silver, gold, indium, bismuth, gallium, cadmium, and zinc, which alloys are characterized by a low melting temperature. Each article includes a band formed of one or more lengths of twisted inter-spiraled wires formed of said material. The inventive articles of jewelry, in addition to a length proportioned for compressive contact against said body parts are provided with several barbs, substantially identical in their appearance to barbs of traditional barbed wire. An angle defined by the axes of the pointed elements of such barbs is less than 180 degrees and, preferably, about 120 degrees, so that the points of the barbed elements of the instant articles of jewelry project away from the skin of the user to diminish the possibility of cutting or scratching.

20 Claims, 7 Drawing Sheets

JEWELRY HAVING THE APPEARANCE OF BARBED WIRE

BACKGROUND OF THE INVENTION

1. Area of Invention

The present invention relates to forms of jewelry and body wear having the appearance of barbed wire.

2. Prior Art

Unconventional forms of jewelry, for example, jewelry formed of a multiplicity of fishhooks are known in the art. For example, see U.S. Pat. No. 6,055,802 (2000) to DiVierti and U.S. Pat. No. 6,339,922 (2002) to Foster.

With particular reference to jewelry of the type having the appearance of barbed wire, the appeal and contemporary interest in jewelry of this type is reflected in certain Internet websites. For example, the Cowboy Shop of Kentucky offers leather barbed wire necklaces and bracelets in which barb-like elements are strung upon a loop of leather cord to result in an article of jewelry which rests loosely about the wrist or neck of a wearer thereof.

As an alternative strategy, the e-business De Tails Toys offers arm bands, wristbands, ankle bands and collars in which barb-like elements are secured upon a thick rubber cord.

A further approach to barbed wire jewelry is the use of specially designed barbs in which the edges thereof have been rounded to reduce the possibility of injury to the user, and in which such barbed elements are connected by a wire band. The same is reflected in the website boondoggles.com.

The website Cowboy Life of Prescott, Arizona, is an on-line retailer of barbed wire chokers and bracelets manufactured by Montana Silversmiths. These products, while attractive, do not fit tightly about the wrist or throat of the wearer and, because they are made entirely of silver and are rigid castings, cannot approximate the appearance of real barbed wire.

In view of the above, the most realistic appearing type of "barbed wire" jewelry is that in which the individual barb elements thereof are connected by leather or rubber cording. However, neither of these two approaches yields a bracelet, necklace or choker that appears entirely realistic and can closely engage the skin of the user for any period of time. That is, none have found a solution which permits realism of appearance coupled with close engagement of the skin that will cause little, if any, discomfort to the user.

In terms of popularity, handcrafted sterling silver has become the most popular medium in which jewelry of this type is produced. In addition to said silver products of Montana Silversmiths, the same is reflected in the products of Marche Noir. Such jewelry is typically considered southwestern jewelry. Jewelry having barbs connected by rubber cording have appeared in biker and other alternative life style settings, as noted above.

Many popular contemporary tattoos have attempted to convey an impression of barbed wire or the like.

Barbed wire per se was invented in 1874 in Texas and has been a particularly American phenomenon in both its use and development. Its early use was largely limited to the establishment of boundaries upon large tracts of land, such as ranches, in the vast areas of the Southwest. However, barbed wire was soon put to military use, beginning with the Spanish American war of 1898, and then later used in World War I in 1917–18, and in World War II as an easily deployable barrier to make more difficult the movement of troops and material on the battlefield. Barbed wire is now widely used today in civilian security applications, most commonly upon fence tops in urban areas. The present invention is, therefore, more closely related to such later uses of barbed wire and the combat retro symbolism associated therewith.

It is in response to such interests that the instant invention is directed.

SUMMARY OF THE INVENTION

The invention relates to an article of jewelry, typically in the nature of a bracelet, arm band, ankle band, choker, anklets, waistbands, toerings, navelrings, proportioned for compressive engagement of the wrist, arm, ankle, waist, toes or throat respectively, which is formed of a malleable material, such as an alloy of two or more of tin, silver, gold, indium, bismuth, gallium, cadmium, and zinc, which alloys are characterized by a low melting temperature. Each article includes a band formed of one or more lengths of twisted inter-spiraled wire(s) formed of said material. The inventive articles of jewelry, in addition to a length proportioned for compressive contact against the wrist, arm, neck, toe, waist or navel of the user, are provided with a plurality of barbs, substantially identical in their appearance to barbs of traditional barbed wire. An angle defined by the axes of the pointed elements of such barbs is less than 180 degrees and, preferably, about 120 degrees, so that the points of the barbed elements of the instant articles of jewelry project away from the skin of the user, diminishing the possibility of cutting or scratching thereby. Further, the fact that the material itself is far softer than is the galvanized high tensile strength barbed wire used in agriculture and security applications yet further reduces the possibility of injury to the user.

The softness of the material of which the inventive article is made facilitates close engagement of the wrist, arm or neck to enhance the realism and artistic impression thereof.

It is accordingly an object of the present invention to provide an article of jewelry, the appearance of which closely resembles barbed wire.

It is another object to provide an article of jewelry of the above type which may be readily used for bracelets, chokers, and armbands, anklets toerings, navelrings, waistbands and which are in substantially compressive engagement with the human body.

It is a further object of the invention to provide an article of jewelry of the above type which is sufficiently malleable to be placed about and against the human body without pain or discomfort resulting therefrom.

It is a yet further object to provide articles of jewelry of differing length that may be readily formed from a roll of barbed-wire appearing material at the point of purchase of the product, so that precise sizing to the requirements of the customer can be accommodated at the time or point of purchase and the angulation of the barbed elements of the article then adapted to the comfort of the user.

It is a still further object to provide a jewelry of the above type in which the color or surface effect of barbed wire may be simulated without the use of copper or any other oxidative metal therein.

It is another object to provide articles of jewelry of the above type which are biocompatible and substantially hypoallergenic.

The above and yet other objects and advantages of the present intention will become apparent from the hereinafter set forth Brief Description of the Drawings, Detailed Description of the Invention and Claims appended herewith.

DETAILED DESCRIPTION OF THE INVENTION

With reference to the perspective views of FIGS. 1 to 5, the inventive article of jewelry, in each of the two embodiments shown, may be seen to include a band 10 which is formed of two lengths of twisted inter-spiraled wires 11A and 11B which, in terms of appearance, is similar to that of traditional barbed wire used for agricultural and security purposes. It is, however, to be noted that the band of inter-spiraled wires may consist of more or less than two lengths, for example, one, three or four, as long as the aggregate radial cross-section of the entire band 10 falls within a range of about four to about eight millimeters, which range has been determined to be optimal for purposes of function and aesthetics.

It is further noted that the invention is made possible through the discovery that a malleable material, such as an alloy of two or more of tin (Sn), silver (Ag), gold (Au), indium (In), bismuth (Bi), gallium (Ga), cadmium (Cd), and zinc (Zn) is much softer than the galvanized high tensile strength steel barbed wire used in traditional applications. This alloy permits compressive engagement of said band against the skin without adverse effect either in terms of cutting, scratching, or allergic irritation as, for example, would be the case if lead or other materials comprised a substantial part of the alloy utilized. It has, thereby, been discovered that such an alloy, generally similar to certain types of solder, which however employ little or no lead or copper, may be advantageously employed as the material of choice for the instant invention. Such a solder is taught in European Patent No. 0507718A1, and such solders are sold online at www.soldersonline.com/.

Figure 1:
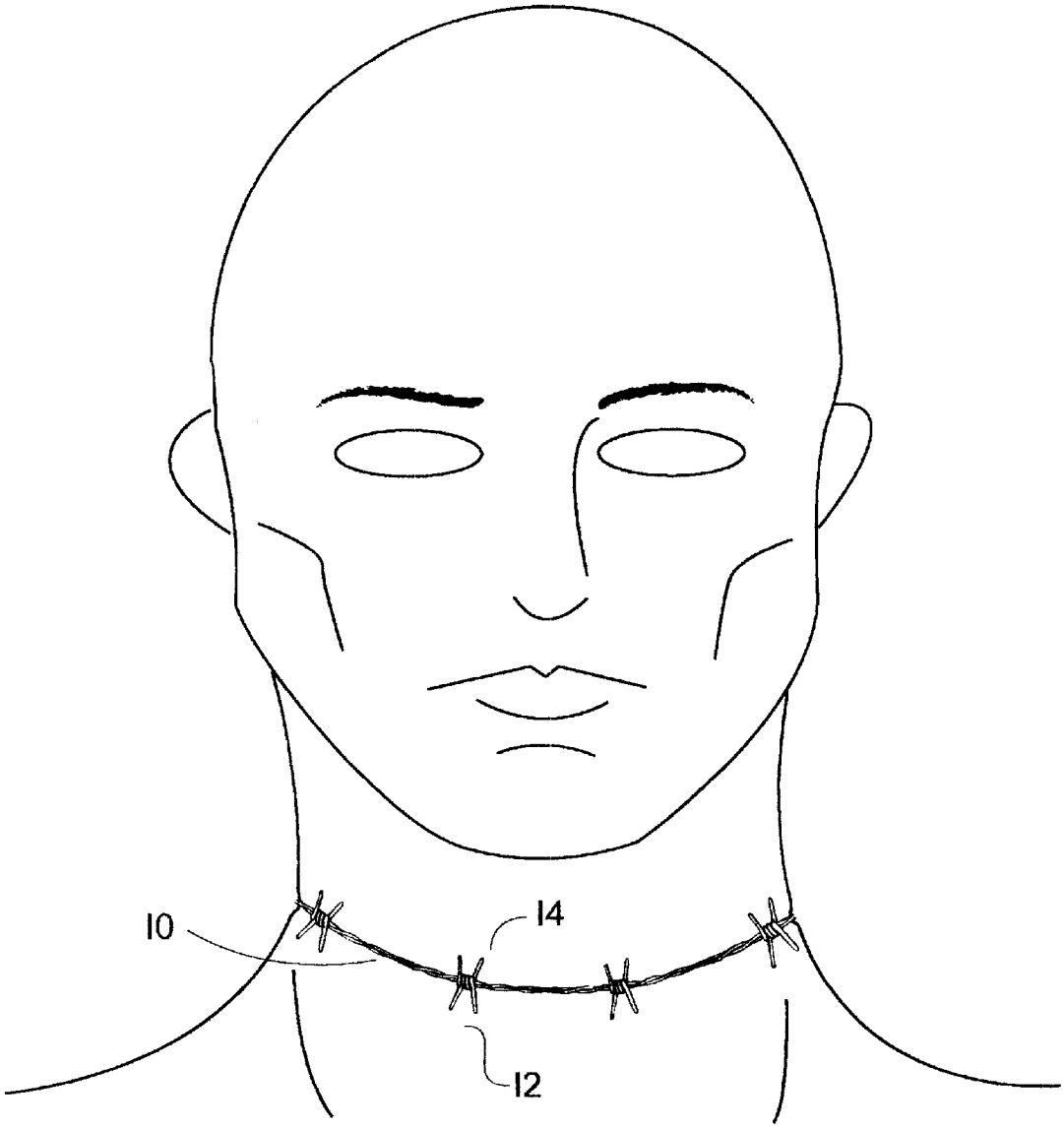
FIG. 1 is a front perspective view showing use of the inventive article of jewelry as a choker and further showing the use of four point barbs therewith, and two interspiralled segments.
Figure 2:
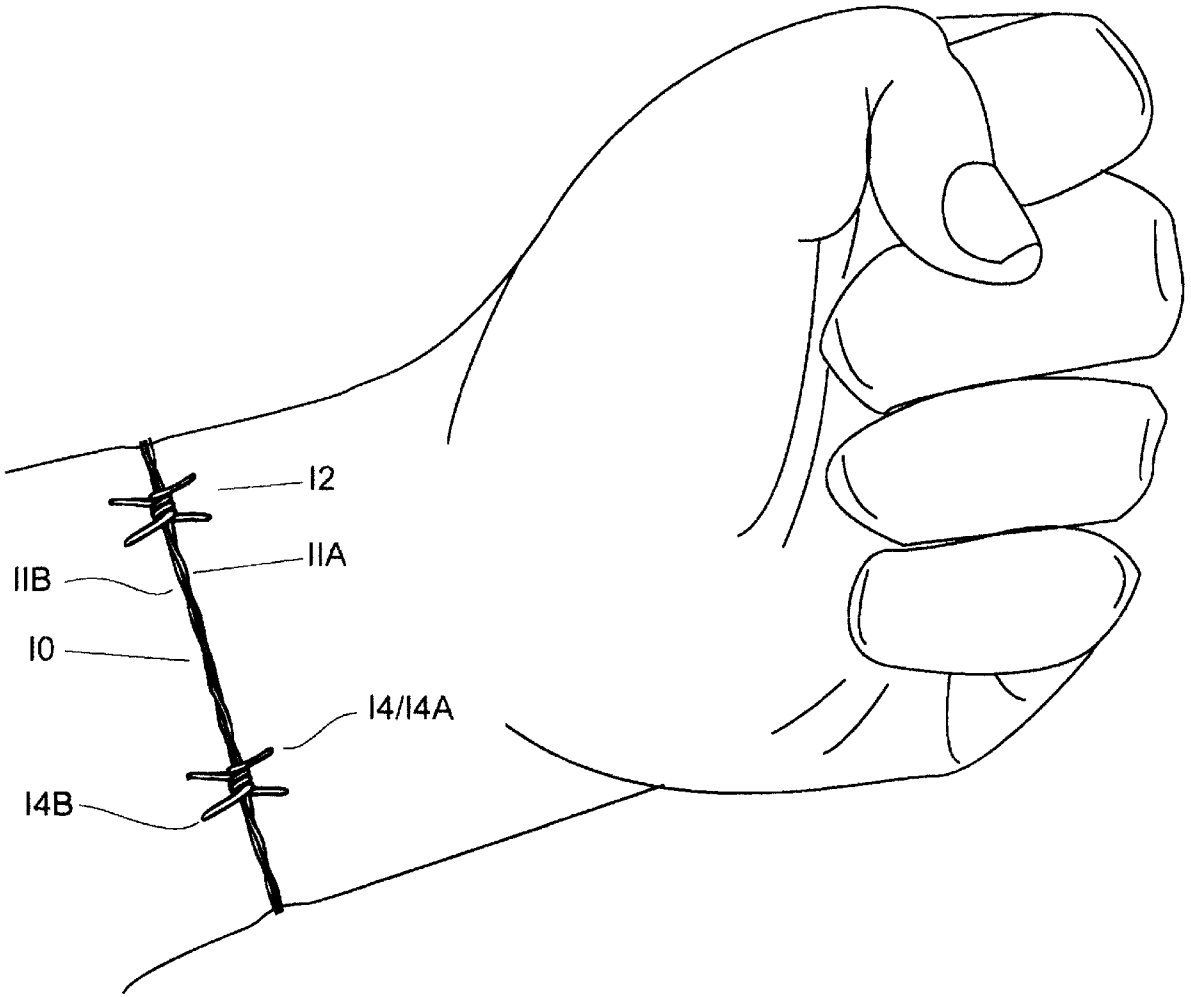
FIG. 2 is a perspective view showing use of the present invention as a bracelet, also using four point barbs.
Figure 3:
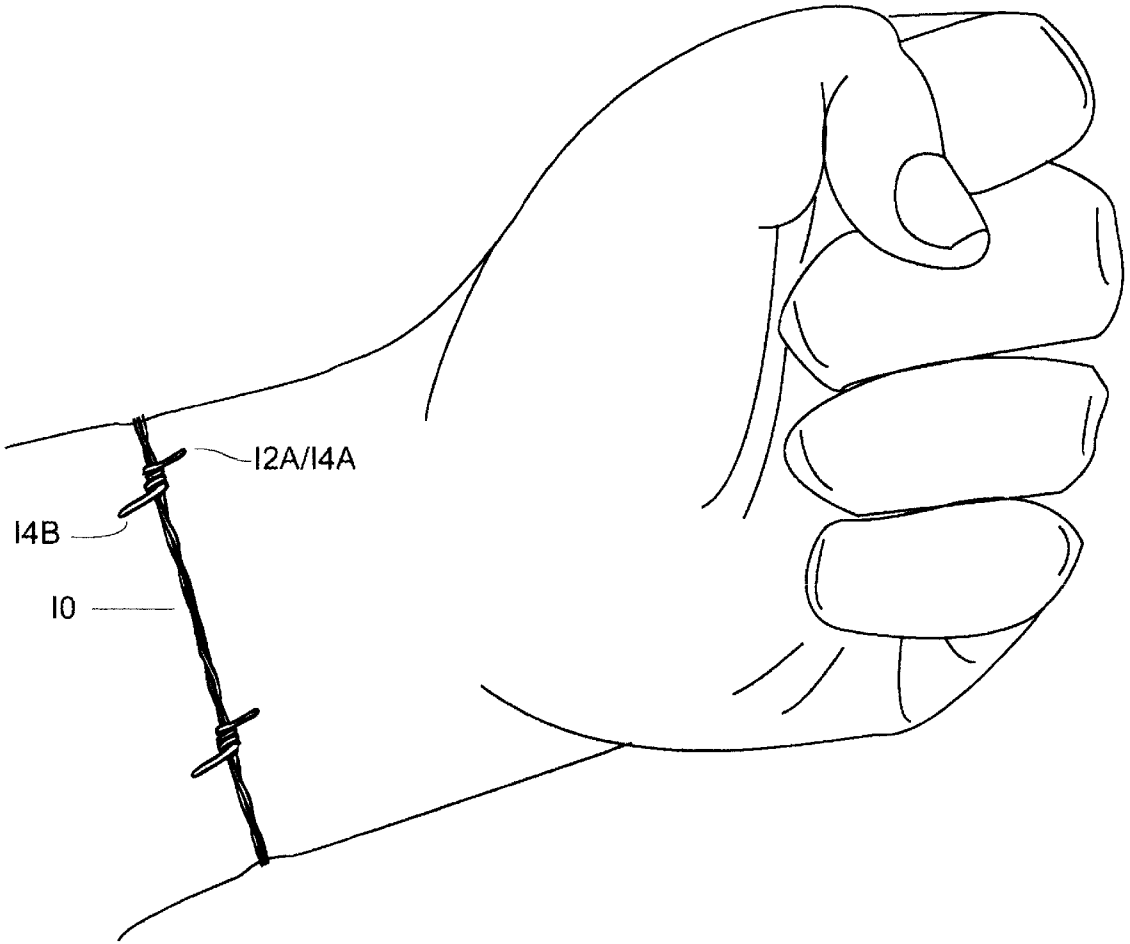
FIG. 3 is a view, similar to that of FIG. 2, however showing the use of two point barbs.
Figure 6:
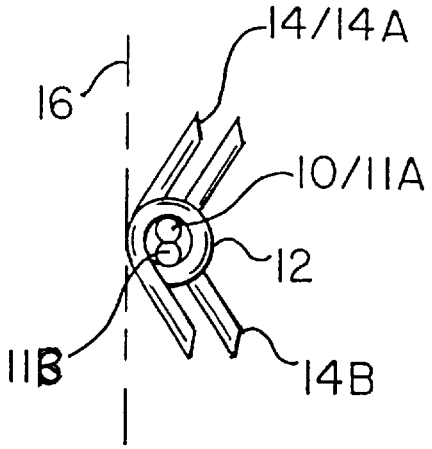
FIGS. 6 and 7 are respective axial views taken in a plane of each barbed element and transverse to the inter-spiraled segments thereof showing a typical obtuse angle between the axes of the points of the respective barb elements that are directed away from the body of the user.
Figure 7:
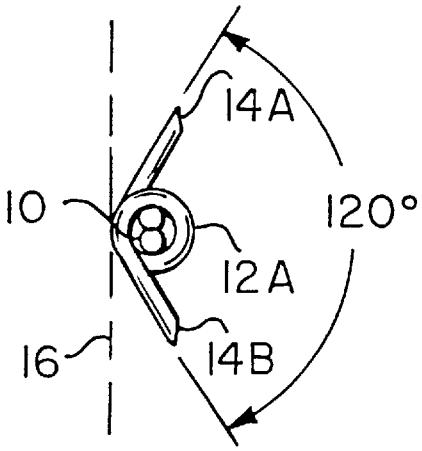

Disposed at respective separations of about four to about nine centimeters are a plurality of barb-like elements 12, each of which include a plurality of points 14 which define respective upper and lower parts 14A and 14B of each elements. As may be noted in a comparison of FIGS. 2 and 3, said barb-like elements may include different numbers of points, for example, four points as is shown in FIGS. 2, and 6, and two points as is shown in FIGS. 3 and 7.

Figure 6A:
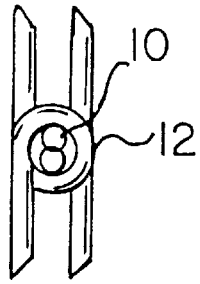
FIG. 6A PRIOR ART
FIGS. 6A and 7A are views of the prior art relative to the views of FIGS. 6 and 7 respectively.
Figure 7A:
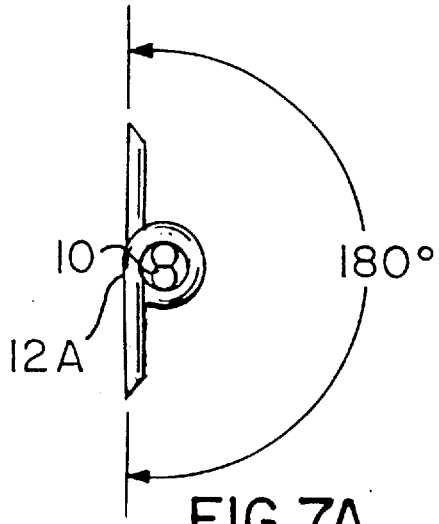
FIG. 7A PRIOR ART

However, by virtue of the use of the soft-malleable alloy as above described, these points will not cause discomfort to the human skin, this, more particularly, by reason of a bending (typically at the point of purchase) of said parts 14A and 14B relative to a virtual surface of rotation 16 of a substantially cylindrical body part 18 (see FIG. 4) which is to be adorned by the article of jewelry. That is, as may be noted in FIGS. 6A and 7A, in the prior art of barbed wire, inclusive of prior efforts to form articles of jewelry having the appearance of barbed wire, the angle between axes defined by said parts 14A and 14B has been approximately 180 degrees. That is, the upper barbed points have been substantially co-linear with the lower barbed points. In distinction, the present invention reduces this 180 degree angle to one of about 120 degrees. It is however to be understood that the range of acceptable angles is considerable and, for example, may readily fall within a range of about 100 to about 160 degrees.

Figure 4:
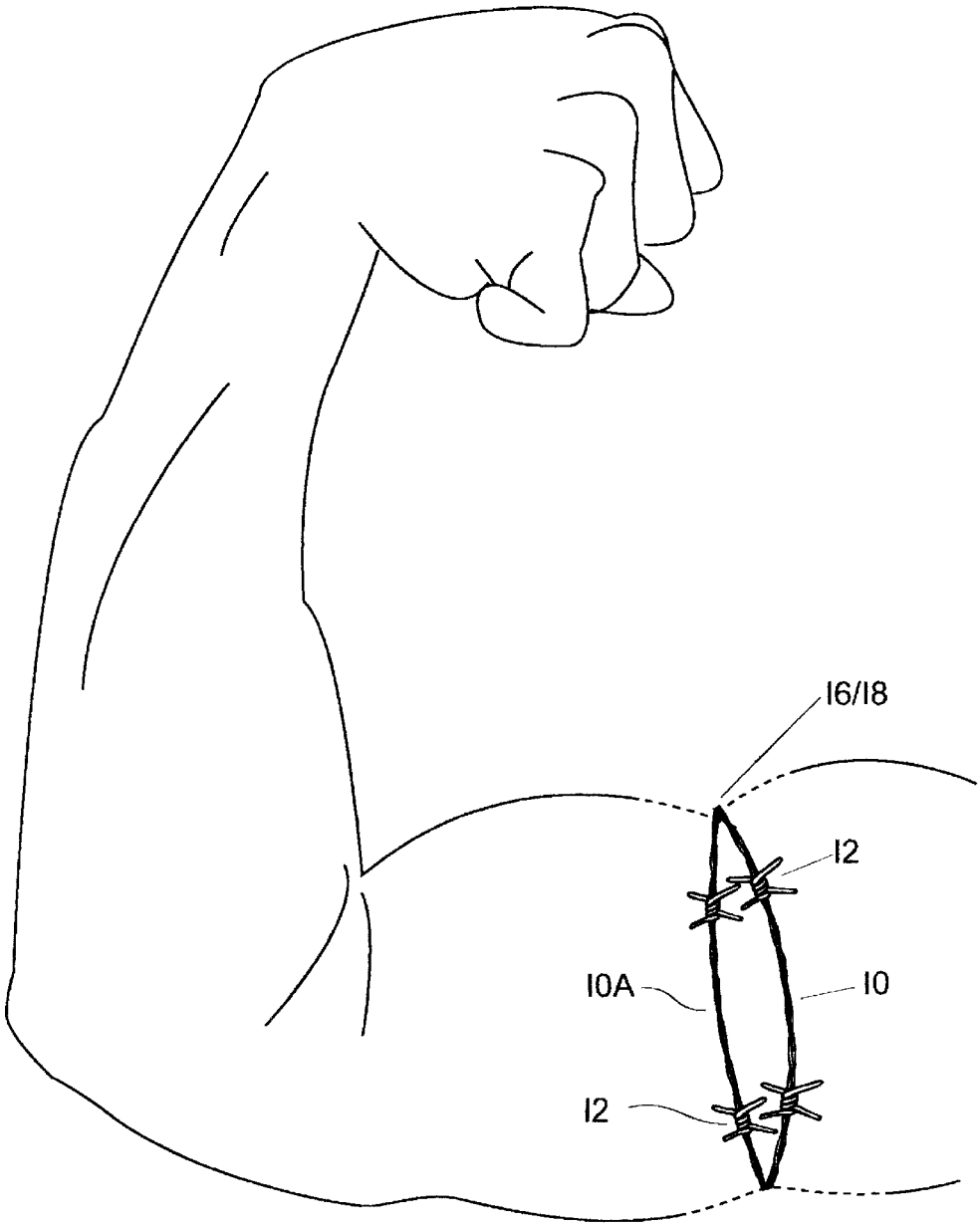
FIG. 4 is a perspective view showing the use of the present article of as an armband.

With further reference to FIG. 4, it is noted that in certain embodiments of the invention, for example, arm bands, a second band 10A of twisted inter-spiraled lengths of wire formed of a malleable material may be employed to thereby create a different effect.

Figure 5:
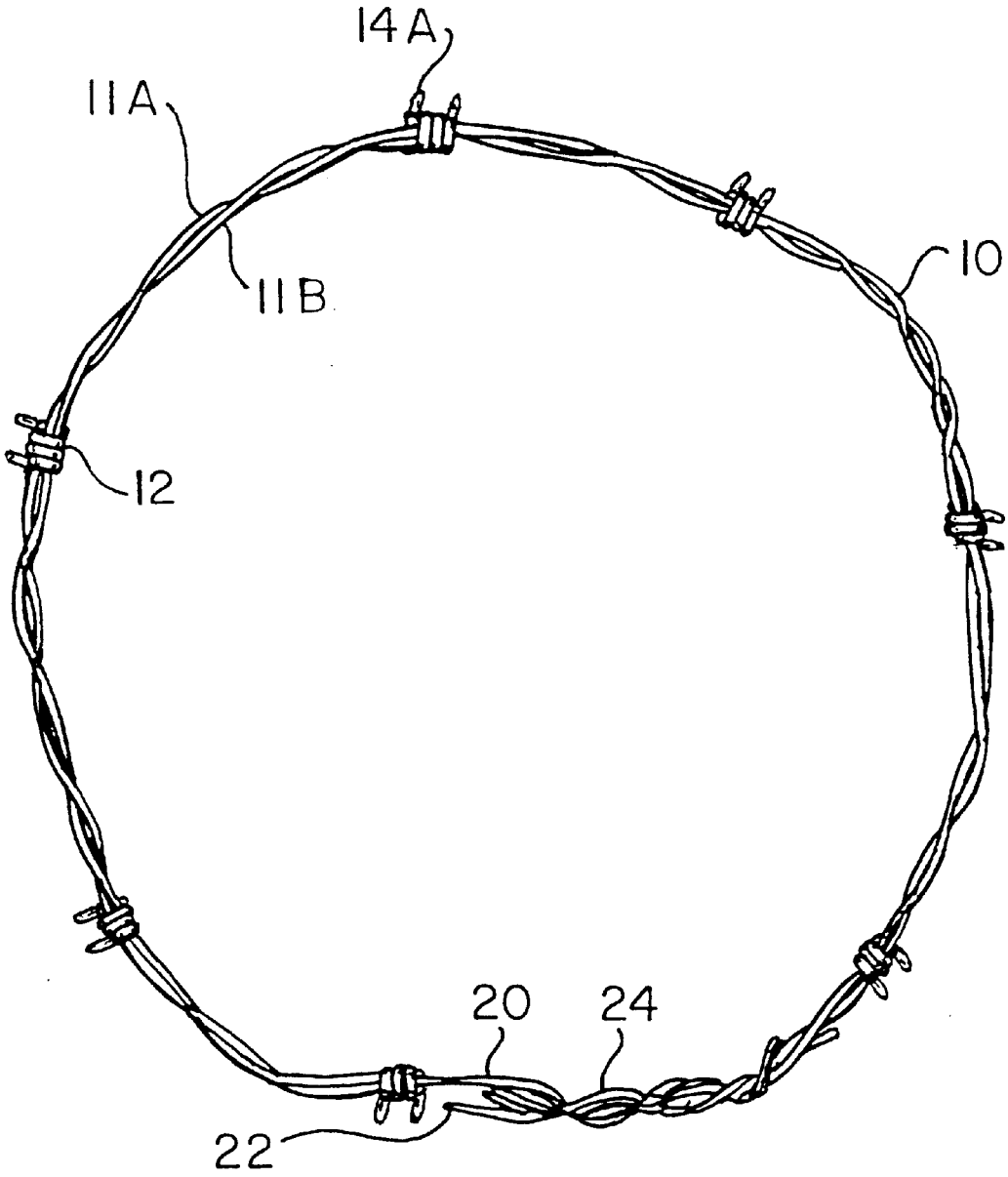
FIG. 5 is a top plan view of an embodiment of the invention using two point barbs, and showing a clasp or closure means thereof.

With reference to the top plan view of FIG. 5, there is shown clasp or closure means 20, which may take a variety of forms; however, the simplest of which is the pulling of an end 22 of band 10 through an eyelet 24 until band 10 achieves a compressive engagement with the body part of the user to be adorned by the article of jewelry. It is anticipated that this will occur at the point of purchase. Other ideas for a clasp include a solder loop of fixed size, soldered ends, and a hook and eye.

Figure 8:
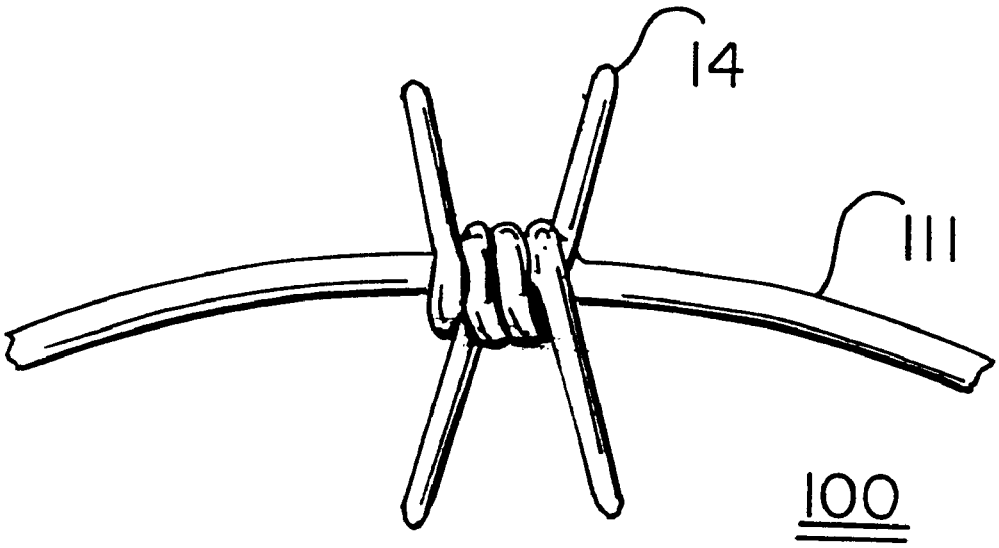
FIG. 8 is a fragmentary view of a bracelet band comprised of one segment of non-twisted wire.

In FIG. 8 is shown a band segment consisting of a single wire.

It is to be appreciated that, in the course of the over 100 year history of barbed wire, many different forms of barbed elements have been suggested, as may be appreciated with reference to the website www.barbwiremuseum.com./barbed%20wire%collage.htm of The Devil's Rope Museum.

With respect to the components of an alloy usable for the instant purpose, we have found the following combinations of metals to be suitable:

| | |
|---|---|
| A. | 52% In, 48% Sn |
| B. | 97% In, 3% Ag |
| C. | 58% Bi, 42% Sn |
| D. | 9% Zn, 91% Sn |
| E. | 70% Cd, 30% Sn |
| F. | 27% Zn, 40% Sn, 33% Cd |

Also, a small percent of gold may be added to any of the above combinations to produce a darker appearance. It has, thereby, been determined that the color of actual barbed wire may be approximated in such alloys. Further, it has been determined that malleability generally corresponds to a low melting point. Such alloys may be formed through the use, or adaptation, of commercially available types of solder. Also, polymers are known that approximate the malleability of such alloys. See U.S. Pat. No. 6,034,205, held by Solvay, SA of Belgium.

Also, we have determined that a preferred diameter of the individual wires that comprise band 10 falls in a range of 1.5 to 2.0 millimeters such that said one or more lengths of said wire, when inter-spiraled and twisted in accordance with the present invention, will produce an aggregate radial diameter or cross section in a range about 4 to about 8 millimeters.

In FIG. 8 is shown an embodiment 100 of the invention in which a wire 111 thereof is not spiraled or inter-spiraled. This embodiment is otherwise similar to those described above.

While there has been shown and described the preferred embodiment of the instant invention, it is to be appreciated that the invention may be embodied otherwise than is herein specifically shown and described and that, within said embodiment, certain changes may be made in the form and arrangement of the parts without departing from the underlying ideas or principles of this invention as set forth in the Claims appended herewith.

What is claimed is:

1. An article of jewelry, comprising:

(a) a band formed of at least one segment of twisted inter-spiraled malleable wire having an aggregate radial diameter or cross-section of about 4 to about 8 millimeters, said band proportioned for compressive securement about a virtual surface of rotation of a substantially cylindrical body part to be adorned by said jewelry; and (b) a plurality of barb-like elements, each formed of a malleable material, secured to said band at respective separations of about four to about nine centimeters, each of said elements having upper and lower parts including points at ends thereof.

2. The article as recited in claim 1, in which each of said upper and lower parts of said elements have a primary axis, in which an intersection, of said respective primary axes of said parts, defines an obtuse angle directed radially away from said surface of rotation and thereby away from said body part to be adorned by the article of jewelry.

3. The article as recited in claim 1, in which said band further includes closure means to secure ends of said at least one segment of wire.

4. The article as recited in claim 3, in which said barb-like elements comprise multi-point elements.

5. The article as recited in claim 4, in which said obtuse angle comprises an angle in a range of about 100 to about 160 degrees.

6. The article as recited in claim 1, in which said article of jewelry comprises a plurality of said bands.

7. The article as recited in claim 4, in which said barb-like elements comprise four point elements.

8. The article as recited in claim 4, in which said barb-like elements comprise two point elements.

9. The article as recited in claim 3, consisting of an alloy of two or more of tin, silver, indium, bismuth, gallium, cadmium, zinc, and gold.

10. The article as recited in claim 9, in which said obtuse angle comprises an angle in a range of about 100 to about 160 degrees.

11. The article as recited, in claim 3, in which said at least one segment of wire comprises two segments thereof.

12. An article of jewelry, comprising:

(a) a band formed of at least one segment of a malleable wire having an aggregate radial diameter or cross-section of about 4 to about 8 millimeters, said band proportioned for compressive securement about a virtual surface of rotation of a substantially cylindrical body part to be adorned by said jewelry; and (b) a plurality of barb-like elements, each formed of a malleable material, secured to said band at respective separations of about four to about nine centimeters, each of said elements having upper and lower parts including points at ends thereof.

13. The article as recited in claim 12 in which each of said parts have a primary axis, in which an intersection, of said respective primary axes of said parts, defines an obtuse angle directed radially away from said surface of rotation and thereby away from said body part to be adorned by the article of jewelry.

14. The article as recited in claim 12, in which said band further includes closure means to secure ends of said at least one segment of wire.

15. The articles as recited in claim 14, in which said barb-like elements comprise multi-point elements.

16. The article as recited in claim 14, in which said obtuse angle comprises an angle in a range of about 100 to about 160 degrees.

17. The article as recited in claim 14, in which said article of jewelry comprises a plurality of said bands.

18. The articles as recited in claim 15, in which said barb-like elements comprises four point elements.

19. The article as recited in claim 15 consisting of an alloy of two or more of tin, silver, indium, bismuth, gallium, cadmium, zinc and gold.

20. The article as recited in claim 15, in which said barb-like elements comprise two point elements.

* * * * *